US008388725B2

(12) United States Patent
Lee et al.

(10) Patent No.: US 8,388,725 B2
(45) Date of Patent: Mar. 5, 2013

(54) APPARATUS AND METHOD FOR MANUFACTURING METAL NANOPARTICLES

(75) Inventors: Young-Il Lee, Anyang-si (KR); Jae-Woo Joung, Suwon-si (KR); Byung-Ho Jun, Seoul (KR); Joon-Rak Choi, Incheon (KR); Kwi-Jong Lee, Hwaseong-si (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 287 days.

(21) Appl. No.: 12/850,276

(22) Filed: Aug. 4, 2010

(65) Prior Publication Data

US 2010/0319489 A1 Dec. 23, 2010

Related U.S. Application Data

(62) Division of application No. 12/149,709, filed on May 7, 2008, now Pat. No. 7,935,169.

(30) Foreign Application Priority Data

May 15, 2007 (KR) ..... 10-2007-0046997

(51) Int. Cl.
*B22F 9/24* (2006.01)

(52) U.S. Cl. ..... 75/371; 75/711; 977/896

(58) Field of Classification Search ..... None
See application file for complete search history.

(56) References Cited

U.S. PATENT DOCUMENTS

| | | | | |
|---|---|---|---|---|
| 6,626,976 | B2 * | 9/2003 | Khan et al. | 75/369 |
| 6,827,786 | B2 | 12/2004 | Lord | |
| 6,967,183 | B2 * | 11/2005 | Hampden-Smith et al. | 502/101 |
| 6,969,505 | B2 | 11/2005 | Tonkovich et al. | |
| 2003/0045425 | A1 | 3/2003 | Ruth et al. | |
| 2004/0025634 | A1 | 2/2004 | Nakamura et al. | |

FOREIGN PATENT DOCUMENTS

| | | |
|---|---|---|
| JP | 2003-514937 | 4/2003 |
| JP | 2006-503790 | 2/2006 |
| JP | 2006-063449 | 3/2006 |
| JP | 2006-188666 | 7/2006 |
| JP | 2007-022911 | 2/2007 |
| KR | 10-2006-0107695 | 10/2006 |
| KR | 10-2006-0122576 | 11/2006 |

OTHER PUBLICATIONS

Korean Office Action issued on Jun. 17, 2008 for Korean Patent Application No. 10-2007-0046997.
United States Office Action issued in U.S. Appl. No. 12/149,709, mailed Sep. 27, 2010.

(Continued)

*Primary Examiner* — George Wyszomierski
(74) *Attorney, Agent, or Firm* — McDermott Will & Emery LLP

(57) ABSTRACT

The present invention relates to an apparatus and a method of manufacturing metal nanoparticles, and more particularly to an apparatus including: a precursor supplying part which supplies a precursor solution of metal nanoparticles; a first heating part which is connected with the precursor supplying part, includes a reactor channel having a diameter of 1 to 50 mm, and is heated to the temperature range where any particle is not produced; a second heating part which is connected with the first heating part, includes a reactor channel having a diameter of 1 to 50 mm, and is heated to the temperature range where particles are produced; and a cooler which is connected with the second heating part and collects and cools metal nanoparticles produced at the second heating part which allows continuous mass production of metal nanoparticles.

7 Claims, 4 Drawing Sheets

OTHER PUBLICATIONS

Partial English translation of Japanese Office Action mailed Mar. 29, 2011.
Japanese Office Action, w/ partial English translation thereof, issued in Japanese Patent Application No. 2008-104968, dated Oct. 4, 2011.

* cited by examiner

APPARATUS AND METHOD FOR MANUFACTURING METAL NANOPARTICLES

CROSS-REFERENCE TO RELATED APPLICATIONS

This application is a Divisional of U.S. patent application Ser. No. 12/149,709, filed on May 7, 2008, now U.S. Pat. No. 7,935,169, and claims the benefit of Korean Patent Application No. 10-2007-0046997 filed on May 15, 2007, with the Korea Intellectual Property Office, the contents of which are incorporated here by reference in their entirety.

BACKGROUND

1. Technical Field

The present invention relates to an apparatus and a method of manufacturing metal nanoparticles and more particularly, to an apparatus and a method of manufacturing nanoparticles in continuous mass scale.

2. Description of the Related Art

There is a large demand for metal nanoparticles as conductive materials or recording materials in various industry fields such as electronic components, coatings, condensers, magnetic tapes, paints, etc. since metal nanoparticles having a nano size exhibits unique characteristics. Accordingly, a great deal of development research is under way on mass production of metal nanoparticles.

Metal nanoparticles have been generally manufactured by various method such as a vapor phase method which supplies metal vapor vaporized to a high temperature, allows collision with gas molecule, and quickly freezes to provide fine particles, a liquid phase method which allows reduction of metal ions by adding a reducing agent into a solution where the metal ions are dissolved, a solid phase method and a mechanical method, etc.

The liquid phase method among those methods has been relatively widely used since it is economical and requires simple processes and mild reaction conditions. A typical liquid phase method produces nanoparticles while nucleation and its growth occur with addition of a metal cation solution and a reducing agent solution into a reactor equipped with a stirrer. Here, uniform metal nanoparticles may be obtained by controlling temperature or concentration of a precursor to induce a uniform reaction in a micro region.

However, it requires a large reactor for mass production and causes ununiform internal temperature of the reactor and uniform concentration of a precursor when the concentration of a precursor is rapidly increased. This ununiformity adversely affect the size distribution of nanoparticles, so that it is an obstacle to manufacture uniform metal nanoparticles.

Methods for continuously manufacturing nanoparticles by employing continuous reaction in a micro channel have been introduced in order to resolve such problems. When a precursor solution is continuously run to a heated micro channel, a temperature of the precursor solution can be raised quickly to a reaction temperature and particles can be formed at the micro region, so that the uniformity of particles can be easily controlled. However, since most of continuous reactions including one disclosed in JP Patent Publication no. 2003-193119 use channels only having a diameter of several micrometers to several hundred nanometers, the channels may be easily blocked during the continuous reaction.

In order to resolve this problem, KR Patent Publication No. 2006-0107695 discloses use of a channel having a wider diameter of 1 to 10 mm and a micro emulsion reaction to prevent the ununiformity caused by using the wider channel. However, the micro emulsion can be only efficient when a low concentration of a precursor is used and a channel having a narrow diameter of about 1 mm is used. Since isolation of produced particles from the emulsion is difficult, the final yield is too low to manufacture nanoparticles in mass scale.

Therefore, a method for manufacturing metal nanoparticles in mass scale is highly demanded.

SUMMARY

The present invention provides an apparatus for continuously manufacturing metal nanoparticles in mass production.

The present invention also provides a method for manufacturing metal nanoparticles using the above-mentioned apparatus.

DESCRIPTIONS FOR MAIN PARTS OF DRAWINGS

Figure 1:
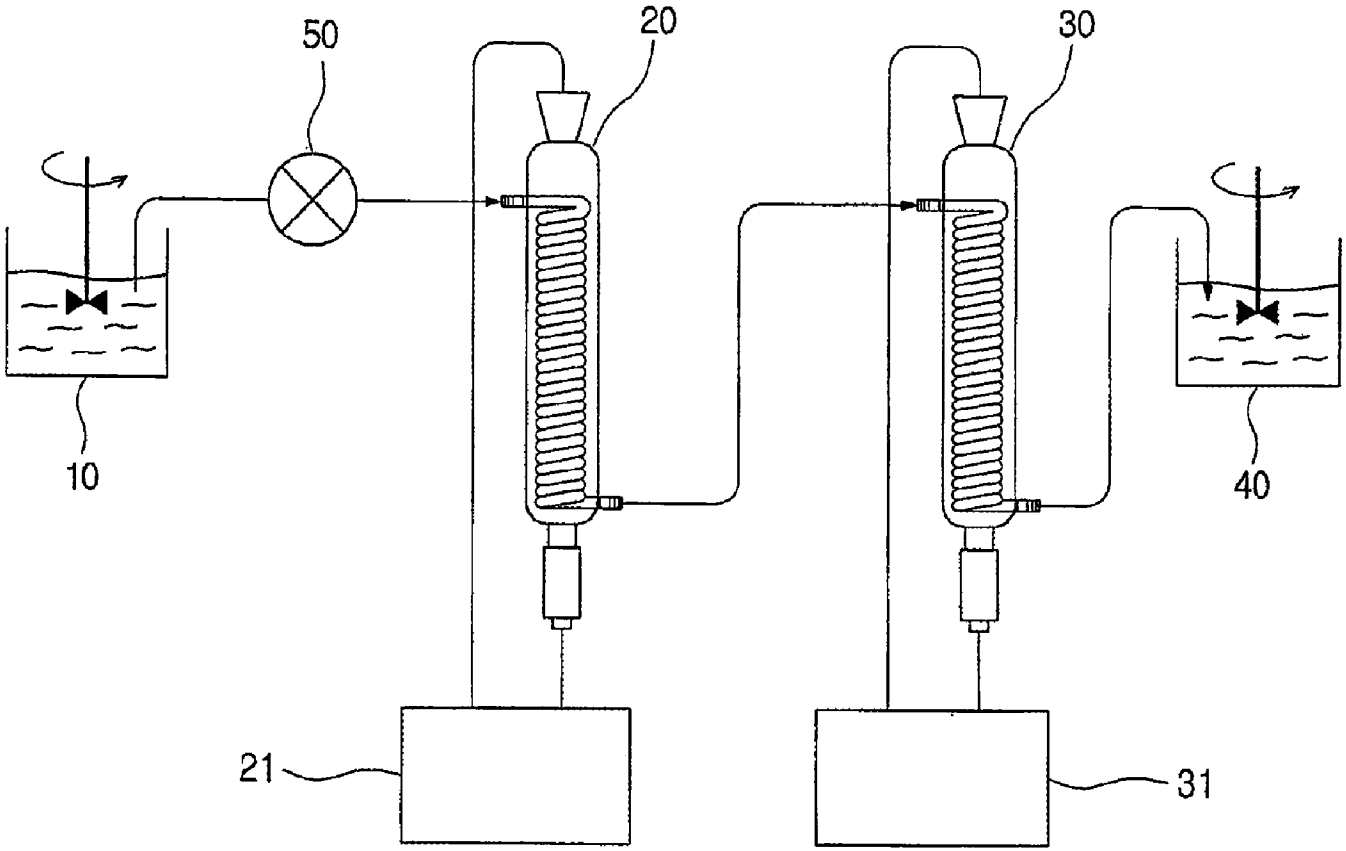
FIG. 1 is a schematic view of an apparatus for manufacturing metal nanoparticles according to an embodiment of the present invention.

| | |
|---|---|
| 10: a precursor supplying part | |
| 20: a first heating part | 21: a first circulating part |
| 30: a second heating part | 31: a second circulating part |
| 40: a cooler | 50: a transferring device |

DETAILED DESCRIPTION

The present invention provides an apparatus for manufacturing metal nanoparticles, including a precursor supplying part which supplies a precursor solution of metal nanoparticles;

a first heating part which is connected with the precursor supplying part, includes a reactor channel having a diameter of 1 to 50 mm, and is heated to the temperature range where any particle is not produced;

a second heating part which is connected with the first heating part, includes a reactor channel having a diameter of 1 to 50 mm, and is heated to the temperature range where particles are produced; and a cooler which collects and cools metal nanoparticles produced at the second heating part.

According to an embodiment of the invention, the apparatus for manufacturing metal nanoparticles may further include a transferring device which transfers the precursor solution from the precursor supplying part. Here, the transferring device may be chosen from a pulsatile pump, a non-pulsatile pump, a syringe pump, and a gear pump.

According to an embodiment of the invention, at least one of the first heating part and the second heating part has a rector channel which is a spiral-shaped condenser type and of which around oil fluid can circulate.

According to an embodiment of the invention, at least one of the first heating part and the second heating part may further include a high frequency device.

According to an embodiment of the invention, the temperature range of the first heating part is 50 to 200° C.

According to an embodiment of the invention, the temperature range of the second heating part is 70 to 400° C.

The present invention also provides a method for manufacturing metal nanoparticles, including:

preparing a precursor solution of metal nanoparticles:

transferring the precursor solution to a first heating part including a reactor channel with a diameter of 1 to 50 mm;

pre-heating the precursor solution at the first heating part to a temperature range where any particle is not produced;

transferring the precursor solution to a second heating part which includes a reactor channel with a diameter of 1 to 50 mm and is heated to a temperature range where particles are produced;

producing metal nanoparticles by heating the precursor solution at the second heating part; and collecting the produced metal nanoparticles by employing a cooler.

According to an embodiment of the invention, each of the first heating part and the second heating part may have independently a rector channel which is a spiral-shaped condenser type.

According to an embodiment of the invention, the precursor solution is transferred at a rate of 0.01 to 100 ml/min.

According to an embodiment of the invention, the pre-heating temperature at the first heating part is in the range of 50 to 200° C. High frequency may be further used at the step of heating at the first heating part.

According to an embodiment of the invention, the pre-heating temperature at the second heating part is in the range of 70 to 400° C. High frequency may be further used at the step of heating at the second heating part.

Hereinafter, embodiments of the apparatus and the method for manufacturing metal nanoparticles according to the invention will be described in detail with reference to the accompanying drawings.

FIG. 1 is a schematic view of an apparatus for manufacturing metal nanoparticles according to an embodiment of the present invention.

Referring to FIG. 1, an apparatus for manufacturing metal nanoparticles according to an embodiment of the invention may include a precursor supplying part 10 which supplies a precursor solution of metal nanoparticles and a first heating part 20 which is connected with the precursor supplying part 10. The first heating part 20 includes a reactor channel having a diameter of 1 to 50 mm and pre-heats the precursor solution transferred from the precursor supplying part 10 to a temperature range where any particle is not produced. Further a second heating part 30 is installed by connecting with the first heating part 20. The second heating part 30 includes a reactor channel having a diameter of 1 to 50 mm and heats the precursor solution transferred from the first heating part 20 to a temperature range where particles are produced. A cooler 40 is installed to be connected with the second heating part 30 and collects metal nanoparticles by cooling the metal nanoparticles produced at the second heating part 30.

In the apparatus of the present invention, the precursor supplying part 10 is to hold a precursor solution of metal nanoparticles and continuously supply it to the first heating part 20 and the second heating part 30.

In an embodiment of the present invention, a precursor solution including a metal salt, a reducing agent, a dispersing agent, etc. is prepared in the precursor supplying part 10, wherein the precursor solution may be prepared as a single solution or a solution of 2 kinds according to desired particles and reaction conditions to be prepared. Here, the precursor solution can be heated to easily dissolve a precursor material at the precursor supplying part to a temperature of 30 to 50° C. The precursor supplying part 10 may further include a stirrer to obtain a homogeneous solution by stirring the precursor solution. The precursor solution may be prepared in a separate container, instead of prepared in the precursor supplying part 10, and then placed into the precursor supplying part 10.

The precursor solution in the precursor supplying part 10 may be transferred to the first heating part by a transferring device 50 such as a pump.

According to an embodiment, a reactor channel of the first heating part 20 is a spiral-shaped condenser type and an oil fluid is circulating around the reactor channel to provide a uniform temperature. When the reactor channel of the spiral-shaped condenser type is used, it allows homogeneous mixing of the precursor solution due to its vortex flow, so that it does not require any physical power from outside. However, structures or shapes of the reactor channel are not limited to this and may be manufactured in various ways. A high frequency device may be further included around the reactor channel to provide homogenous mixing of the precursor solution.

The reactor channel installed into the first heating part 20 has a diameter of 1 to 50 mm. The narrower the channel is the more uniform the particles are since a ratio of the volume to the surface area of the solution passing through the narrower channel decreases which makes easy to control heat conductivity and concentration. When the diameter of the channel is less than 1 mm, the channel may be blocked, while when it is bigger than 50 mm, the ununiformity within the channel is increased which makes difficult to provide uniform nanoparticles. It is preferred that the diameter of the channel be 5 to 40 mm, more preferred about 10 to 30 mm.

A material of the channel may be varied such as glass, metal, plastic, alloy and the like according to its use.

Heating of the first heating part 20 may provide a uniform temperature from inside the reactor channel to the precursor solution by circulating an oil fluid around the reactor channel through a first circulator 21 as shown in FIG. 1. Besides the oil fluid as a heating medium, an electric furnace, an infra-red heater, a high frequency heater and the like can be used according to shapes or structures of the channel.

The first heating part 20 may heat to the temperature where the precursor solution is not reduced. Here, the pre-heating temperature may be varied with types of particles or precursors to be manufactured. It may be in the range of 50 to 200° C. If the pre-heating temperature is lower than 50° C., the reaction may not be controlled dedicatedly, while if it is higher than 200° C., the reduction may occur.

The precursor solution pre-heated at the first heating part 20 is transferred to the second heating part 30 which is connected with the first heating part 20.

According to an embodiment, the reactor channel of the second heating part 30 may be a spiral-shaped condenser type like that of the first heating part 20. An oil fluid may circulate around the reactor channel to provide a uniform temperature through a second circulator 31 as shown in FIG. 1.

The reactor channel of the second heating part 30 may have a diameter of 1 to 50 mm, preferably 5 to 40 mm, more preferably 10 to 30 mm like that of the first heating part 20. Here, a material of the reactor channel may be varied such as glass, metal, plastic, alloy and the like according to its use.

The second heating part 30 is quickly heated to a temperature where the precursor solution passed through the first heating part 20 is reduced. It may be in the range of 70 to 400° C. If it is lower than 70° C., the precursor solution is not smoothly reduced, while if it is higher than 400° C., it may cause explosion due to increase of the internal pressure of the second heating part with exceeding the boiling temperature of a solvent used to form the precursor solution.

Since the first heating part and the second heating part are connected next to each other, it reduces the retention time of the precursor solution at the second heating part. Further, the first heating part 20 is pre-heated, so that it is easy to quickly raise the reaction temperature to the reduction temperature, which allows uniform heating at the second heating part without time difference and eventually results in the formation of fine and uniform nanoparticles with speedy reaction processing.

According to an embodiment of the invention, any transferring device may be used such as a simple pulsatile pump, a non-pulsatile pump, a syringe pump, and a gear pump if it can continuously supply the precursor solution.

Since the reactor channel having a diameter of 1 to 50 mm is used and pre-heating is performed in the present invention, the precursor solution may be transferred at a rate of 0.01 to 100 ml/min. Mass production is achieved within a shorter period of time when the transferring rate is increased. The transferring rate may be in the range of 10 to 100 ml/min for mass production.

The metal nanoparticles produced at the second heating part 30 are collected at the cooler 40 and its size can be controlled while cooling. For example, when the metal nanoparticles are rapidly frozen by brining them to the cooler 40 such as a beaker filled with ice water, it may prevent over growth of the particles. Cooling and washing the nanoparticles with an appropriate solution may be performed simultaneously. At this time, the solution in which the nanoparticles are produced is stirred to provide uniform washing.

Hereinafter, although more detailed descriptions will be given by examples, those are only for explanation and there is no intention to limit the invention.

Example 1

In preparing copper nanoparticles by employing an apparatus as shown in FIG. 1, copper sulfate 0.2 mol, sodium hypophosphite 0.3 mol, PVP 2 mol, ethylene glycol 1 L were mixed in a beaker and dissolved at 40° C. by stirring to provide a precursor solution. Condenser-typed reactors having a diameter of 10 mm were prepared and a first heating part was heated to 80° C. and a second heating part to 90° C. by circulating with heated-oil. The precursor solution was injected at a rate of 40 ml/min by using a pulsatile pump. Copper nanoparticles having dark brown color was prepared when the solution was reduced by passing the second heating part and cooled in a beaker filled with ice water. The copper nanoparticles were washed with water and acetone and dried in a vacuum oven at 50° C. to yield 12 g of the target product.

Figure 2:
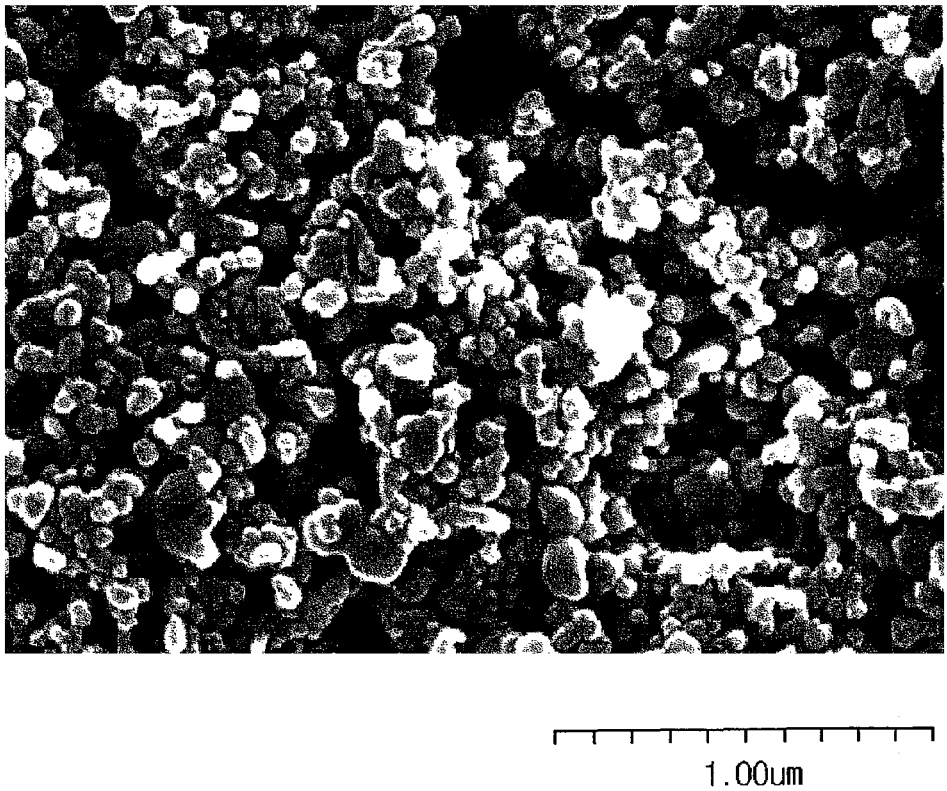
FIG. 2 is a transmission electron micrograph image of metal nanoparticles prepared in Example 1 of the present invention.

FIG. 2 is a transmission electron micrograph image of metal nanoparticles prepared in Example 1 of the present invention. It is noted that an average diameter of the copper particles is 50 nm as shown in the TEM image.

Figure 3:
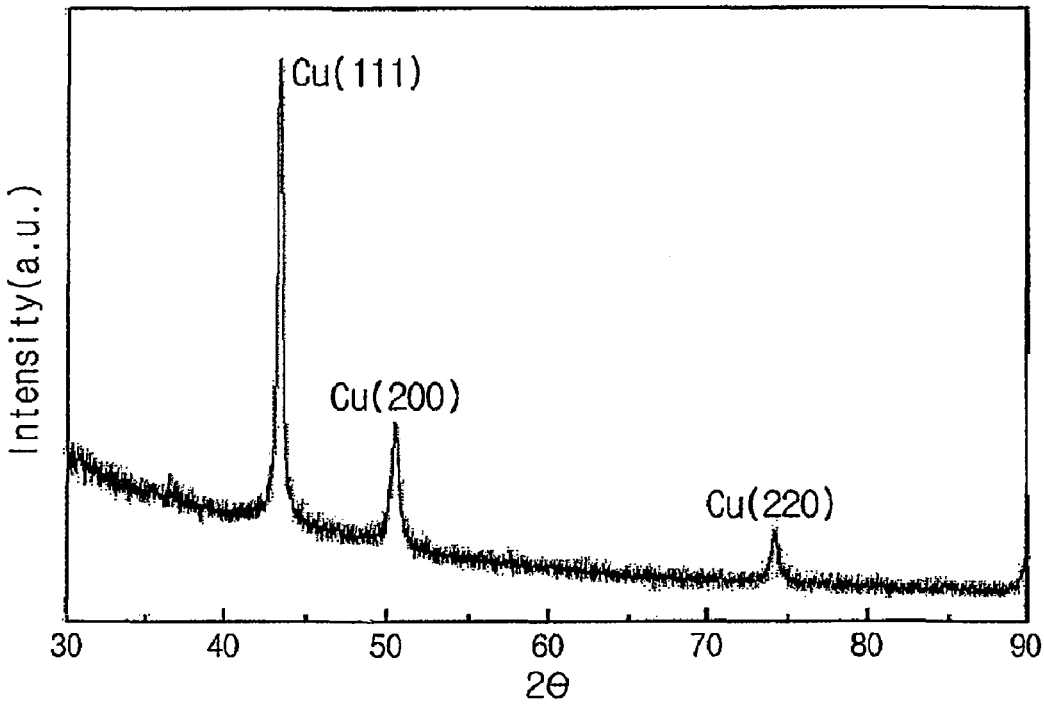
FIG. 3 is a result for X-ray diffraction of metal nanoparticles prepared in Example 1 of the present invention.

FIG. 3 is a result for X-ray diffraction of metal nanoparticles prepared in Example 1 of the present invention. It is noted that pure copper particles are produced as shown in the X-ray diffraction.

Figure 4:
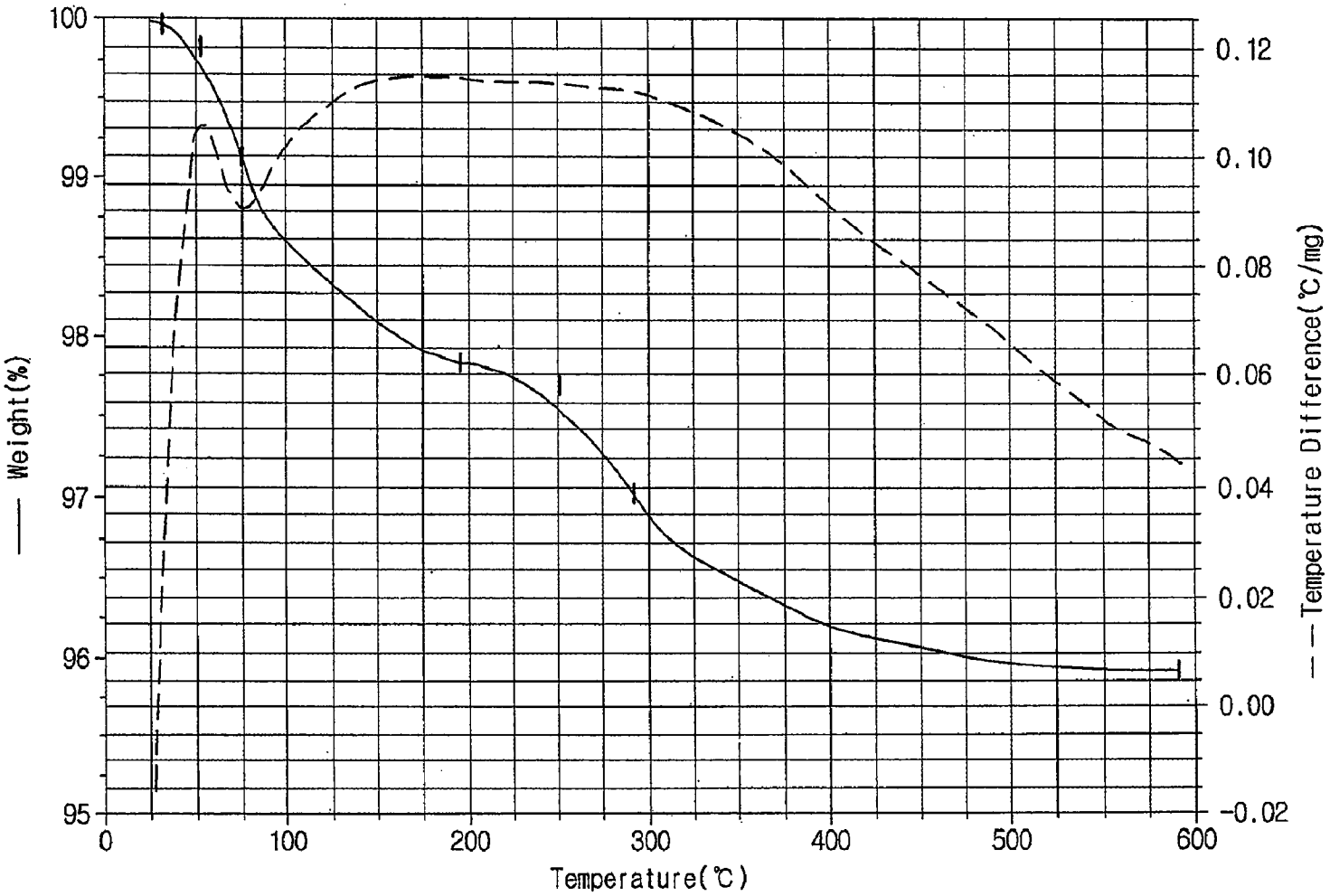
FIG. 4 is a result of the thermal analysis of copper nanoparticles prepared in Example 1 of the present invention.

FIG. 4 is a result of thermal analysis of copper nanoparticles prepared in Example 1 of the present invention. It is noted that 4% of an organic material is contained in the copper nanoparticles as shown in the thermal analysis.

As described above, the apparatus and the method for manufacturing metal nanoparticles of the present invention allow mass production of metal nanoparticles in a short period of time by continuously supplying a precursor solution.

While the present invention has been described with reference to particular embodiments, it is to be appreciated that various changes and modifications may be made by those skilled in the art without departing from the spirit and scope of the present invention, as defined by the appended claims and their equivalents.

What is claimed is:

1. A method for manufacturing metal nanoparticles, comprising:

preparing a solution containing a precursor of metal nanoparticles:

transferring the solution containing a precursor of metal nanoparticles to a first heating part including a reactor channel with a diameter of 1 to 50 mm;

pre-heating the solution containing a precursor of metal nanoparticles at the first heating part to a temperature range where any particle is not produced;

transferring the solution containing a precursor of metal nanoparticles to a second heating part which includes a reactor channel with a diameter of 1 to 50 mm and is heated to a temperature range where particles are produced;

producing metal nanoparticles by heating the solution containing a precursor of metal nanoparticles at the second heating part; and collecting the produced metal nanoparticles by employing a cooler.

2. The method of claim 1, wherein each of the first heating part and the second heating part independently has a reactor channel which is a spiral-shaped condenser.

3. The method of claim 1, wherein the solution containing a precursor of metal nanoparticles is transferred at a rate of 0.01 to 100 ml/min.

4. The method of claim 1, wherein the pre-heating temperature at the first heating part is in the range of 50 to 200° C.

5. The method of claim 1, wherein the step of heating at the first heating part additionally uses a high frequency device.

6. The method of claim 1, wherein the heating temperature at the second heating part is in the range of 70 to 400° C.

7. The method of claim 1, wherein the step of heating at the second heating part additionally uses a high frequency device.

* * * * *